US005601030A

United States Patent [19]

Brouillette

[11] Patent Number: 5,601,030

[45] Date of Patent: Feb. 11, 1997

[54] RAILRAOD BOGIE, FOR CONNECTING VEHICLES IN AN ARTICULATED TRAIN

[76] Inventor: Michael F. Brouillette, R.D. 2, Box 613, Millerstown, Pa. 17062

[21] Appl. No.: 610,202

[22] Filed: Mar. 4, 1996

[51] Int. Cl.[6] ..... B61F 3/12

[52] U.S. Cl. ..... 105/159; 105/4.2; 410/53; 410/57

[58] Field of Search ..... 105/4.1, 4.2, 155, 105/215.2; 410/53, 56, 57, 91

[56] References Cited

U.S. PATENT DOCUMENTS

| | | | |
|---|---|---|---|
| 3,665,865 | 5/1972 | Pelz | 105/183 |
| 5,009,169 | 4/1991 | Viens | 105/4.1 |
| 5,020,445 | 6/1991 | Adams, Jr. | 105/159 |
| 5,107,772 | 4/1992 | Viens | 105/159 |
| 5,123,358 | 6/1992 | Kemppainen et al. | 105/167 |
| 5,199,359 | 4/1993 | Bedard et al. | 105/4.1 |
| 5,213,049 | 5/1993 | Kobayashi | 105/168 |
| 5,291,835 | 3/1994 | Wicks | 105/159 |
| 5,335,602 | 8/1994 | Richter et al. | 105/168 |

*Primary Examiner*—S. Joseph Morano

[57] ABSTRACT

A railroad bogie is disclosed. Such railroad bogie has a bogie body with a horizonal frame with front and rear ends and elongated sides therebetween. The bogie body also has an upstanding front plate and rear plate and side plates therebetween with lower ends secured to the frame to define an open top. A pair of front railroad wheels are provided as well as a pair of rear railroad wheels. The bogie has a pair of front support arms and a pair of rear support arms, the front and rear support arms being pivotally secured to the frame adjacent to the front and rear ends respectively for rotatable movement between a lower inoperative position and a raised operative position. The support arms are each in a generally A-shaped configuration with an intermediate cross beam and with a pivot rod at lower ends and with a transverse brace at upper ends. Each transverse brace is formed in an L-shaped configuration with extents for receiving a portion of a truck trailer to be supported and transported. A pneumatic cylinder for each pair of support arms is provided and has a lower end pivotally secured to a cross beam. The cylinder is adapted to raise and lower the transverse braces. Lastly provided are a pair of vertical posts having upper ends rotatably secured to the cross beam and free lower ends positionable in cups secured to the frame adjacent to central extents thereof.

4 Claims, 5 Drawing Sheets

RAILRAOD BOGIE, FOR CONNECTING VEHICLES IN AN ARTICULATED TRAIN

BACKGROUND OF THE INVENTION

1. Field of the Invention

The present invention relates to a new and improved railroad bogie and, more particularly, pertains to effecting the safe and efficient transportation of truck trailers over railroad tracks.

2. Description of the Prior Art

The use of devices for transporting truck trailers of various designs and configurations is known in the prior art. More specifically, devices for transporting truck trailers of various designs and configurations heretofore devised and utilized for the purpose of increasing the safety and efficiency of truck trailer transportation while reducing costs through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices including those for effecting the transportation of truck trailers over railroad tracks. By way of example, U.S. Pat. No. 3,665,865 to Pelz dated May 30, 1972 discloses a low-platform railway car bogie.

U.S. Pat. No. 5,009,169 to Viens dated Apr. 23, 1991 discloses a twin axle rail bogie for convertible rail-highway vehicles.

U.S. Pat. No. 5,107,772, also to Viens, dated Apr. 28, 1992 discloses a rail bogie for transporting semi-trailers with vertically movable king pin assemblies on common frame.

U.S. Pat. No. 5,123,358 to Kemppainen et al. dated Jun. 23, 1992 discloses bogie construction of a railway car.

U.S. Pat. No. 5,213,049 to Kobayashi dated May 25, 1993 discloses a railway vehicle bogie.

Lastly, U.S. Pat. No. 5,335,602 to Richter et al. discloses bogies for rail vehicles.

In this respect, the railroad bogie according to the present invention substantially departs from the conventional concepts and designs of the prior art, and in doing so provides an apparatus primarily developed for the purpose of the effecting safe and efficient transportation of truck trailers over railroad tracks.

Therefore, it can be appreciated that there exists a continuing need for a new and improved railroad bogie which can be used for effecting the transportation of truck trailers over railroad tracks. In this regard, the present invention substantially fulfills this need.

SUMMARY OF THE INVENTION

In view of the foregoing disadvantages inherent in the known types of devices for transporting truck trailers of various designs and configurations now present in the prior art, the present invention provides an improved railroad bogie. As such, the general purpose of the present invention, which will be described subsequently in greater detail, is to provide a new and improved railroad bogie and methods which have all the advantages of the prior art and none of the disadvantages.

To attain this, the present invention essentially comprises a new and improved railroad bogie for effecting the transportation of truck trailers over railroad tracks comprising, in combination, a bogie body having a lower generally horizontal frame with a front end and a rear end and elongated sides therebetween, the bogie body also having an upstanding front plate and rear plate and side plates therebetween with lower ends secured to the frame to define an open top; a pair of front railroad wheels with an axle rotatably secured to the frame adjacent to the front end and a pair of rear railroad wheels with an axle secured to the frame adjacent to the rear end; a pair of front support arms and a pair of rear support arms, the front and rear support arms being pivotally secured to the frame adjacent to the front and rear ends respectively for rotatable movement between a lower inoperative position and a raised operative position for supporting portions of truck trailers to be transported, the support arms each being in a generally A-shaped configuration with an intermediate cross beam and with a pivot rod at lower ends and with a transverse brace at upper ends, each transverse brace being formed in an L-shaped configuration with a lower horizontal extent and an upper vertical extent for receiving a portion of a truck trailer to be supported and transported; a pneumatic cylinder for each pair of support arms and having a lower end pivotally secured with respect to a pivot rod and an upper end pivotally secured to a cross beam, the cylinder adapted to raise and lower the transverse braces; a pair of vertical posts having upper ends rotatably secured to the cross beam and free lower ends positionable in cups secured to the frame adjacent to central extents thereof; a brake system having horizontally reciprocable shoes coupled to the frame and movable into and out of locking contact with the wheels with a source of pressurized air for providing actuating forces and with pneumatic lines positioned on the frame and extending from adjacent the forward end to adjacent the rearward end for the passage of pressurized air to the sources for braking the wheels and with an actuation wheel secured to one side of the frame for the manual providing of actuating forces for braking the wheels; and standard railroad coupling mechanisms extending forwardly of the forward end and rearwardly of the rearward end for coupling together plural bogies to be transported in systems configuration.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved railroad bogie which has all the advantages of the prior art devices for transporting truck trailers of various designs and configurations and none of the disadvantages.

It is another object of the present invention to provide a new and improved railroad bogie which may be easily and efficiently manufactured and marketed.

It is a further object of the present invention to provide a new and improved railroad bogie which is of a durable and reliable construction.

An even further object of the present invention is to provide a new and improved railroad bogie which is susceptible of a low cost of manufacture with regard to both materials and labor, and which accordingly is then susceptible of low prices of sale.

Even still another object of the present invention is to effect the safe and efficient transportation of truck trailers over railroad tracks.

Lastly, it is an object of the present invention to provide a railroad bogie. Such railroad bogie has a bogie body with a horizontal frame with front and rear ends and elongated sides therebetween. The bogie body also has an upstanding front plate and rear plate and side plates therebetween with lower ends secured to the frame to define an open top. A pair of front railroad wheels with an axle rotatably secured to the frame adjacent to the front end are provided as well as a pair of rear railroad wheels with an axle secured to the frame adjacent to the rear end. The bogie has a pair of front support arms and a pair of rear support arms, the front and rear support arms being pivotally secured to the frame adjacent to the front and rear ends respectively for rotatable movement between a lower inoperative position and a raised operative position. The support arms are each in a generally A-shaped configuration with an intermediate cross beam and with a pivot rod at lower ends and with a transverse brace at upper ends. Each transverse brace is formed in an L-shaped configuration with extents for receiving a portion of a truck trailer to be supported and transported. A pneumatic cylinder for each pair of support arms is provided and has a lower end pivotally secured with respect to a pivot rod and an upper end pivotally secured to a cross beam. The cylinder is adapted to raise and lower the transverse braces. Lastly provided are a pair of vertical posts having upper ends rotatably secured to the cross beam and free lower ends positionable in cups secured to the frame adjacent to central extents thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
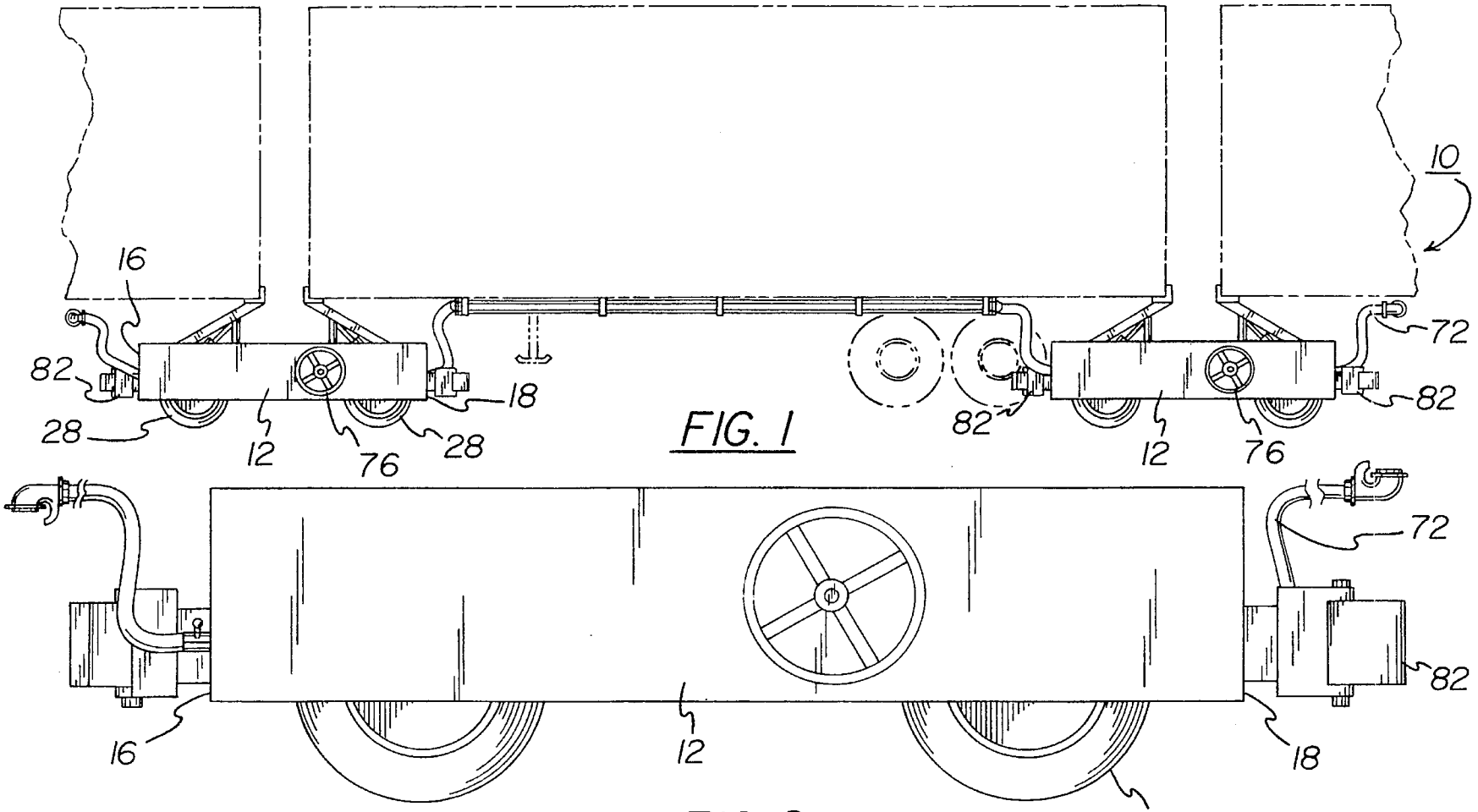
FIG. 1 is a side elevational view of a plurality of new and improved railroad bogies constructed in accordance with the principles of the present invention.
FIG. 2 is an enlarged side elevational view of one of the bogies.
Figure 3:
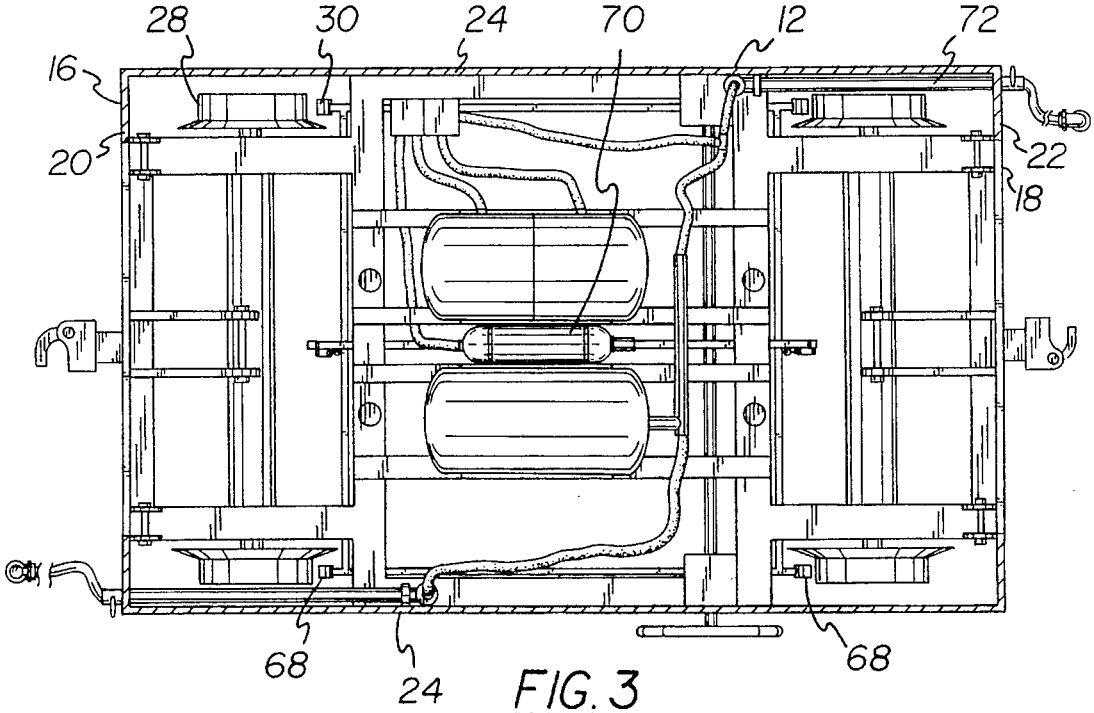
FIG. 3 is a bottom elevational view of one of the bogies shown in FIGS. 1 and 2.
Figure 4:
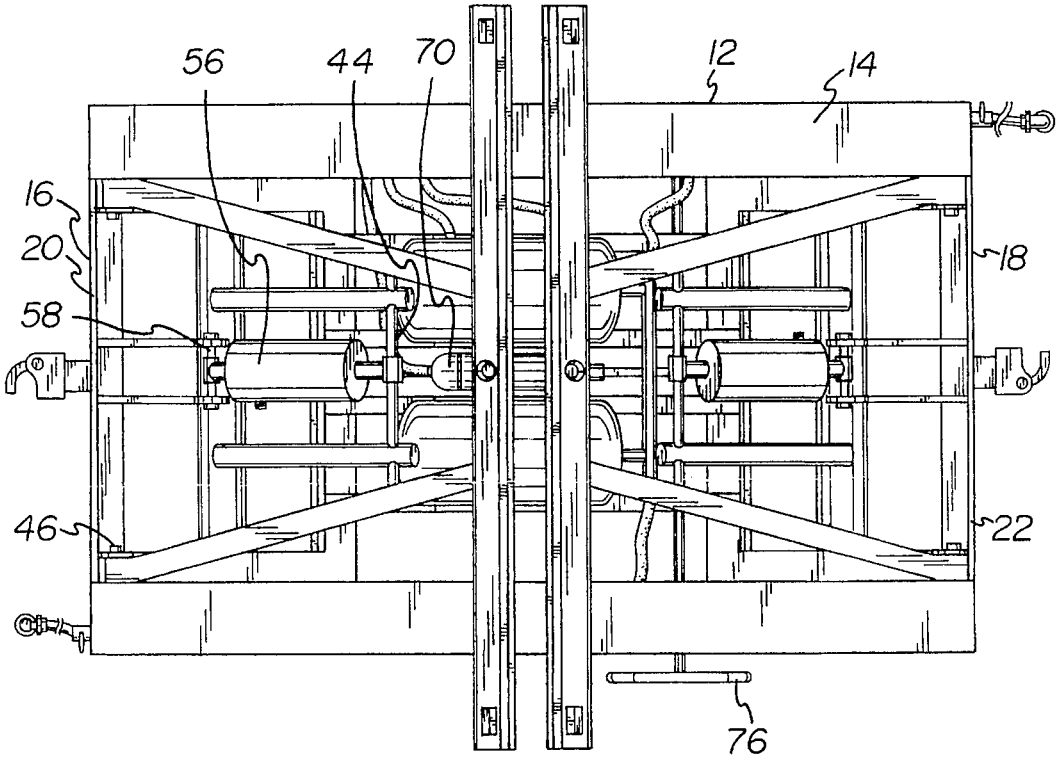
FIG. 4 is a top elevational view of the railroad bogie shown in FIG. 3.
Figure 5:
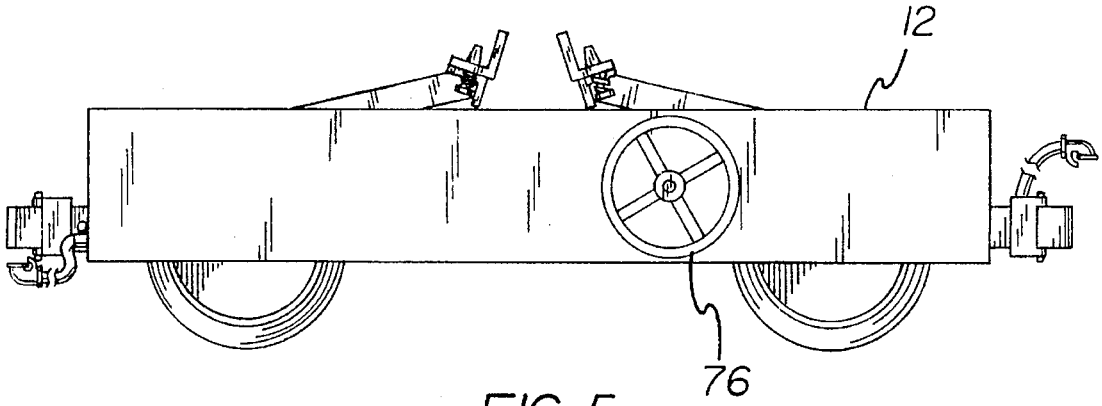
FIG. 5 is a side elevational view of the railroad bogie of the prior Figures with the supporting mechanisms in a partially elevated position.
Figure 6:
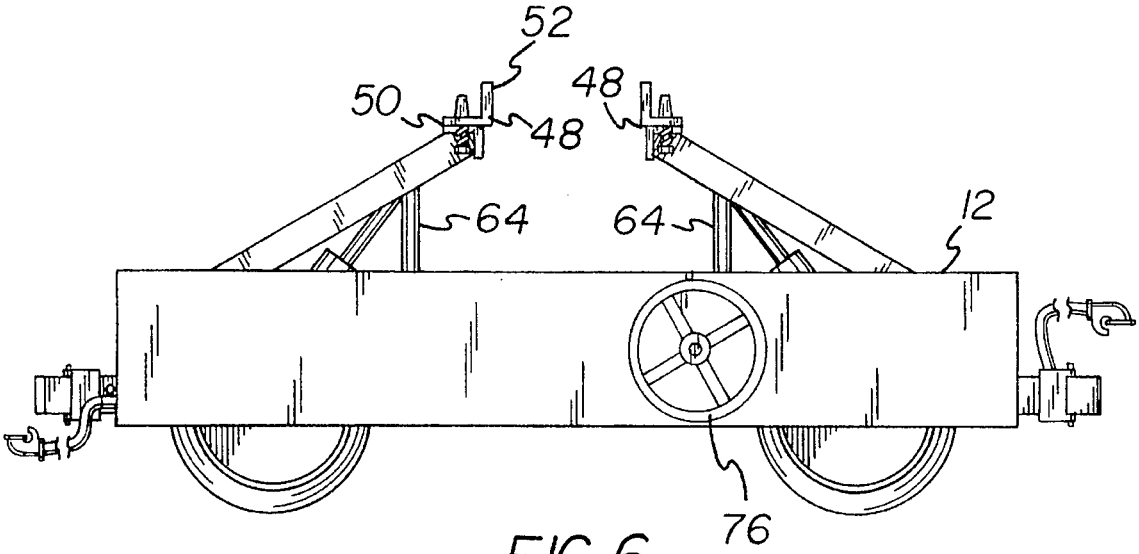
FIG. 6 is a side elevational view similar to FIG. 5 but with the support components in a fully raised operable position.
Figure 7:
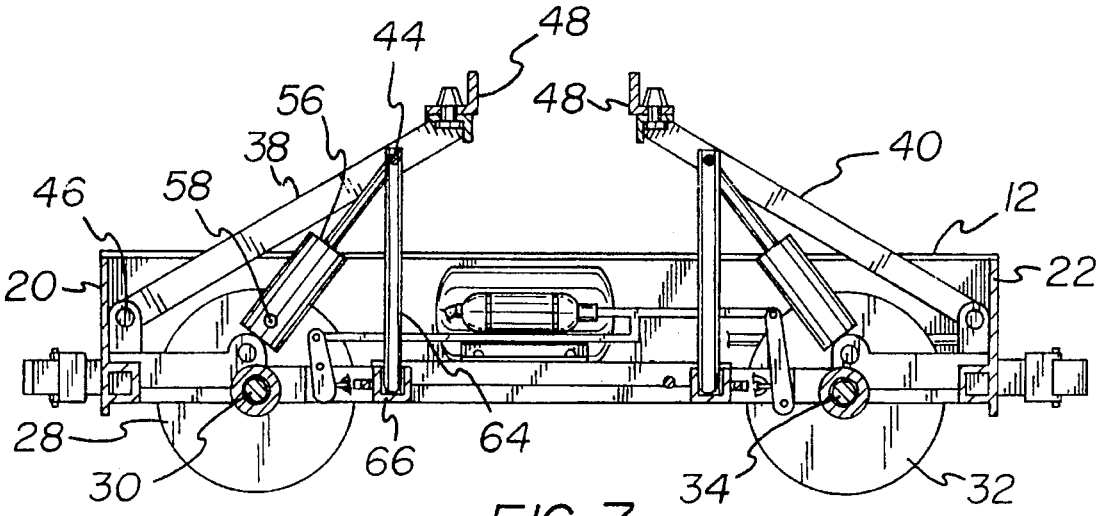
FIG. 7 is a cross-sectional view of the apparatus shown in FIG. 6.
Figure 8:
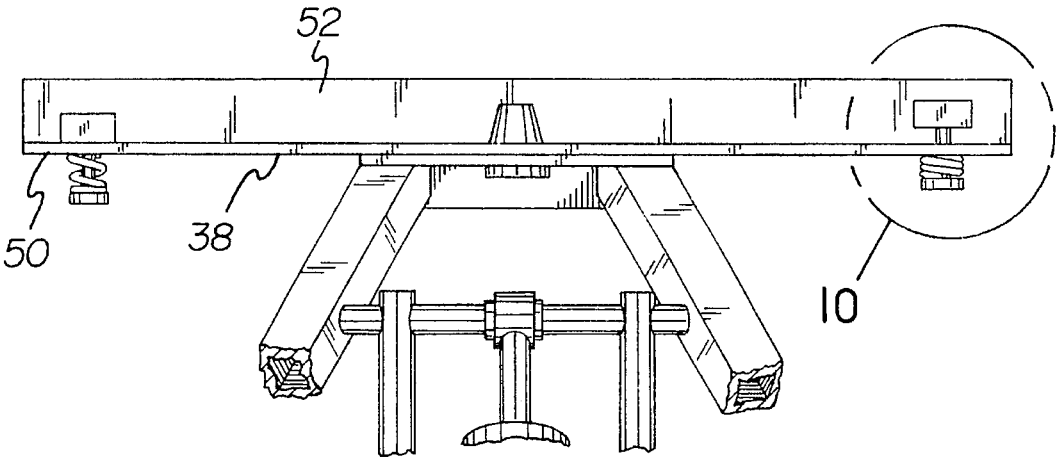
FIG. 8 is a perspective illustration of the upper portions of the support mechanisms shown in FIG. 7.
Figure 9:
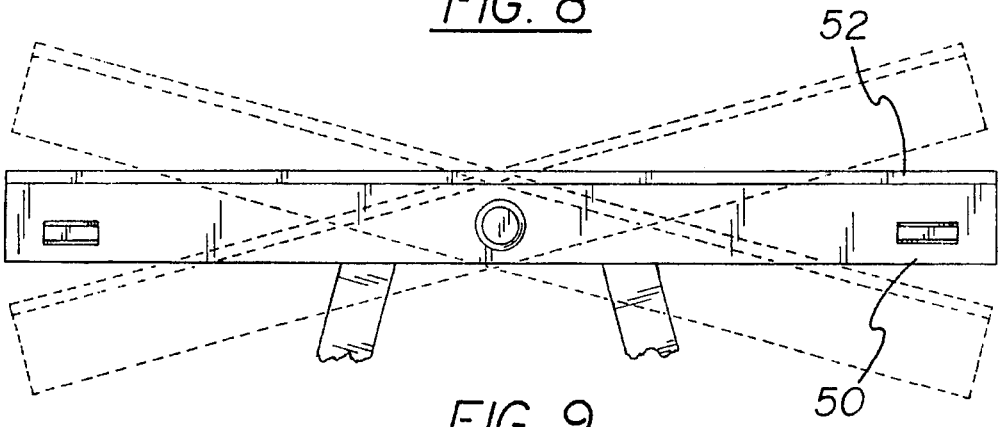
FIG. 9 is a top elevational view of the mechanisms shown in FIG. 8 illustrating a limited twisting capability.
Figure 10:
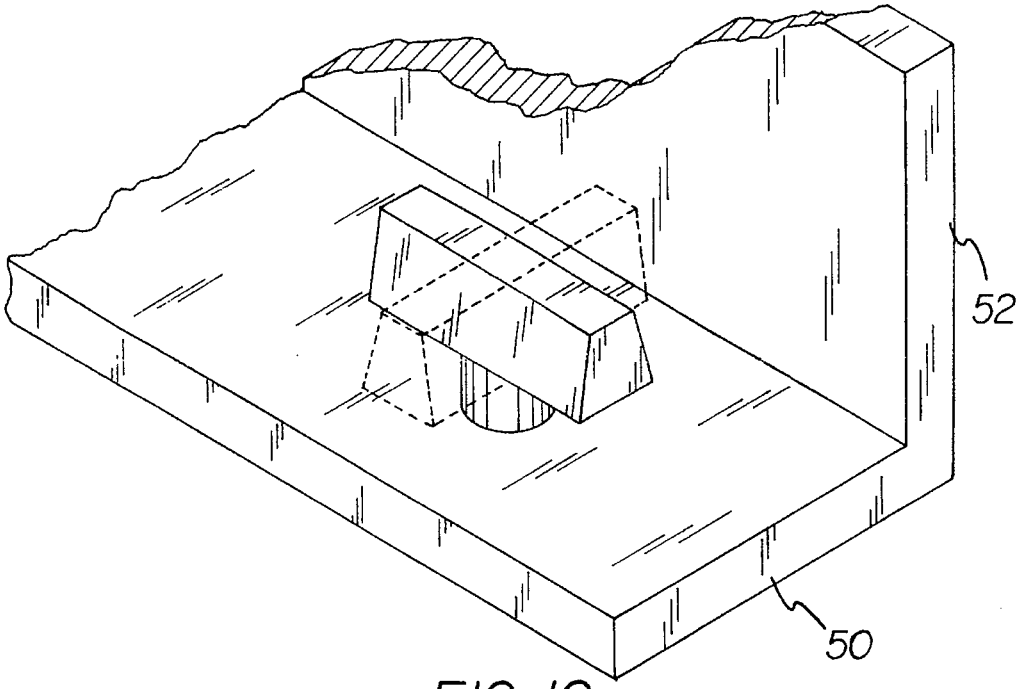
FIG. 10 is an enlarged perspective view taken at circle 10 of FIG. 8.
Figure 11:
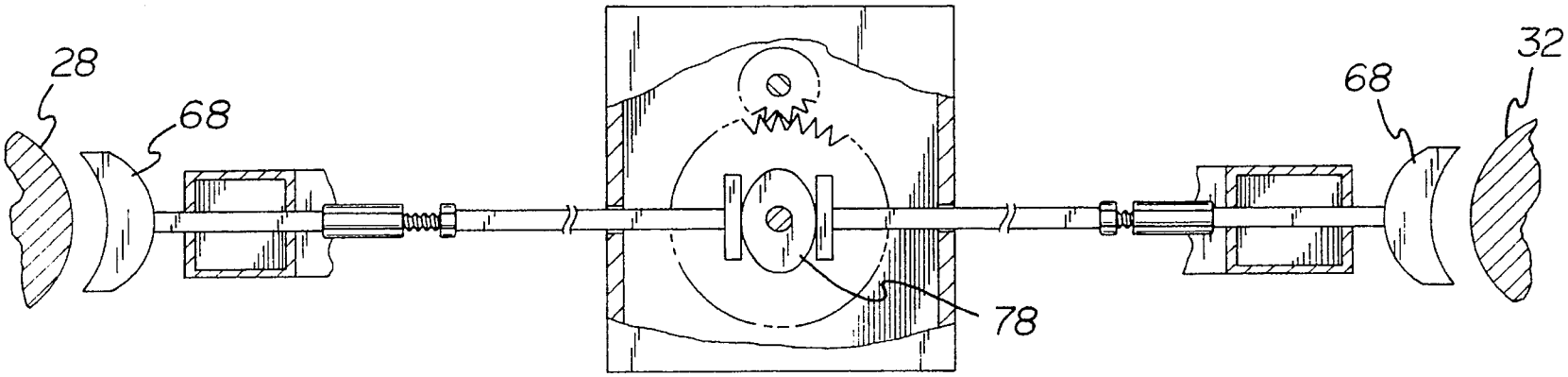
FIG. 11 is a cross-sectional view showing the braking mechanisms operable from a manual handcrank.
Figure 12:
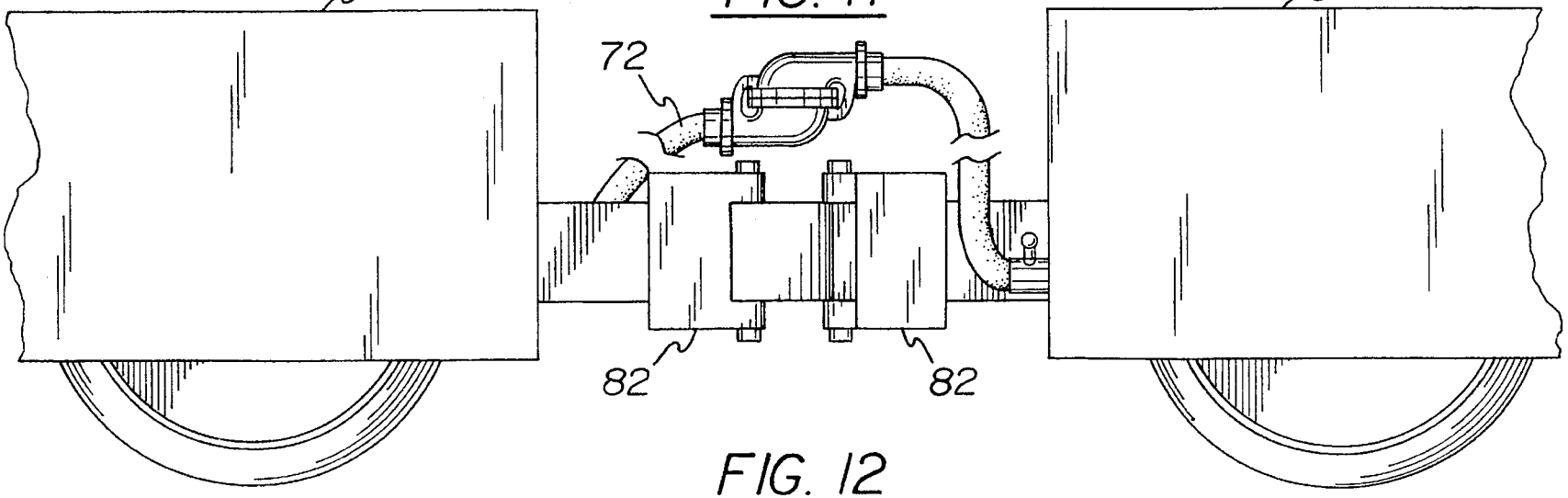
FIG. 12 is an enlarged side elevational view of the coupling between associated bogies for transportation when not conveying truck trailers.

With reference now to the drawings, and in particular to FIG. 1 thereof, the preferred embodiment of the new and improved railroad bogie embodying the principles and concepts of the present invention and generally designated by the reference numeral 10 will be described.

The present invention, the new and improved railroad bogie is a system 10 comprised of a plurality of components. In their broadest context, the components include a bogie body, wheels, support arms, a pneumatic cylinder, vertical posts, a brake system and coupling mechanisms. Each of the individual components is specifically configured and correlated one with respect to the other so as to attain the desired objectives.

A central component of the system 10 of the present invention is a bogie body 12. Such body has a lower generally horizontal frame 14. The frame has a front end 16 and a rear end 18. It also has elongated sides therebetween. The front and rear are referred herein although it should be realized that the bogie may be moved in either direction. The bogie body also has an upstanding front plate 20 and an upstanding rear plate 22 with parallel side plates 24 between the front and rear plates. In addition, the plates have lower ends secured to the frame and define an open top thereabove.

Secured to the bogie body are pairs of front railroad wheels 28 with an axle 30. The axle and wheels are rotatably secured with respect to the plate adjacent to the front end. Similarly configured are a pair of rear railroad wheels 32 also with an axle 34 and also secured to the frame adjacent to the rear end.

Next provided are a pair of front support arms 38 and a pair of rear support arms 40. The support arms are of similar construction. The front and rear support arms are individually pivotally secured to the frame. Such securement is adjacent to the front end and to the rear end of the frame. The support arms are adapted for locatable movement between a lower inoperative position when not in use and a raised operative position when in use for supporting portions of the truck trailers to be transported.

Each of the pair of support arms is in a generally A-shaped configuration. Such arms include an intermediate cross beam 44 as well as a parallel pivot rod 46 at the lower end of each pair of support arms. In addition, a transverse brace 48 is located at the upper ends of each of the pair of support arms. In addition, each transverse brace is formed in an L-shaped configuration with a lower horizontal extent 50 upon which one end of a truck trailer is positioned. Each L-shaped configuration has an upper vertical extent 52 for abating undesired forward and rearward movement of a supported truck trailer being supported and transported.

Operatively associated with each of the pair of support arms is a pneumatic cylinder 56. There is a pneumatic cylinder for each pair of support arms which is formed to have a lower end. Such lower end of each cylinder is pivotally secured with respect to a pivot rod 58. In addition, each pneumatic cylinder has an upper end pivotally secured to the cross beam 44. The pneumatic cylinders are adapted to raise and lower the transverse braces between the inoperative and operative positions.

Additional support is provided to the support arms and transverse braces through a pair of vertical posts 64 for each pair of support arms. Such posts have upper ends rotatably secured to the cross beam. The posts also have lower free ends which are positionable in cups 66 secured to the frame adjacent to central extents thereof.

In association with each bogie there is provided an independent braking system operatively coupled with the other railroad bogies when used in systems configuration. Each braking system has a horizontally reciprocable pair of shoes 68 respectively coupled to the frame. The shoes are movable into and out of locking contact with the wheels through frictional connections therebetween. Each braking system also includes a source 70 of pressurized fluid. Such air is providing the actuation forces for effecting the braking system. Pneumatic lines 72 are positioned on the frame along the length of each bogie and extend from adjacent the forward end to adjacent the rearward end for the passage of the pressurized air to the sources for braking the wheels.

In addition to the pneumatic braking of the wheels of each bogie there is provided a manually operable actuation wheel 76. Such wheel is secured to one side of the frame. Such is for manual rotation to provide actuating forces for braking the wheels. Rotation of the actuation wheel rotates the driving gear to rotate a driven gear. The driven gear rotates an oval-shaped cam 78 to move horizontal rods outwardly to move the shoes into contact with the wheels for braking purposes. Counter-rotation of the manual wheel functions to relieve such braking forces.

Lastly, there is provided for each bogie standard railroad coupling mechanisms 82 extending forwardly of the forward end and rearwardly of the rearward end of each bogie. Such coupling mechanisms are for releasably coupling together plural bogies to be transported in systems configuration.

The present invention comprises bogies that are placed at the ends of a truck trailer when it is to travel on railroad tracks rather than on the highways and roads. They are low in height, with steel wheels at each corner, similar to those used on railroad cars, and are flanged on the outer rims to prevent slipping off of the tracks. Attachment to the semi-trailer would be made at three points, a 2-inch diameter tapered pin in the center and locking pins on either side. Air over hydraulic pistons raise up the unit to a height of 15 inches permitting two connected support arms to drop straight down into cups of about 3 to 4 inches in size. The trailer is then lower so the wheels are about 12 inches off the ground. Each bogie is piped for connection to the standard air system found on trains, and equipped with an hand brake. Couplings at each end allow hook-up to locomotives, as well as other units and types of rolling equipment.

When a truck trailer is to continue its voyage by rail, it is taken to a loading site and placed on two bogies. After being elevated, the road wheels are well off of the ground with the weight supported entirely by the bogies, ready to continue the trip by rail locomotion. This dual capability allows traffic managers to plan and schedule optimum means of transport. World trading has developed to the point where merchandise often must be sent by all three means, boat, truck and train, so the present invention adds a vital link for such efforts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved railroad bogie for effecting the transportation of truck trailers over railroad tracks comprising, in combination:

a bogie body having a lower generally horizontal frame wit a front end and a rear end and elongated sides therebetween, the bogie body also having an upstanding front plate and rear plate and with side plates having lower ends therebetween secured to the frame to define an open top;

a pair of front railroad wheels with an axle rotatably secured to the frame adjacent to the front end and a pair of rear railroad wheels with an axle secured to the frame adjacent to the rear end;

a pair of front support arms and a pair of rear support arms, the front and rear support arms being pivotally secured to the frame adjacent to the front and rear ends respectively for rotatable movement between a lower inoperative position and a raised operative position for supporting portions of truck trailers to be transported, the support arms each being in a generally A-shaped configuration with an intermediate first cross beam and with a first pivot rod at lower ends and with a transverse brace at upper ends, each transverse brace being formed in an L-shaped configuration with a lower horizontal extent and an upper vertical extent for receiving a portion of a truck trailer to be supported and transported;

a pneumatic cylinder for each pair of support arms and having a lower end pivotally secured with respect to a second pivot rod and an upper end pivotally secured to said first cross beam, the cylinder adapted to raise and lower the transverse braces;

a pair of vertical connected posts having upper ends rotatably secured to the cross beam and free lower ends positionable in cups secured to the frame adjacent to central extents thereof;

a brake system having horizontally reciprocable shoes coupled to the frame and movable into and out of locking contact with the axles with a source of pressurized air for providing pressurized air for generating actuating forces and with pneumatic lines positioned on the frame and extending from adjacent the forward end to adjacent the rear end for the passage of said pressurized air from the sources for braking the wheels and with an actuation wheel secured to one side of the frame for the manual providing of actuating forces for braking the wheels; and coupling mechanisms extending forwardly of the forward end and rearwardly of the rearward end for coupling together plural bogies to be transported in systems configuration.

2. A railroad bogie comprising:

a bogie body having a lower generally horizontal frame with a front end and a rear end and elongated sides therebetween, the bogie body also having an upstanding front plate and rear plate and with side plates having lower ends therebetween secured to the frame to define an open top;

a pair of front railroad wheels with an axle rotatably secured to the frame adjacent to the front end and a pair of rear railroad wheels with an axle secured to the frame adjacent to the rear end;

a pair of front support arms and a pair of rear support arms, the front and rear support arms being pivotally secured to the frame adjacent to the front and rear ends respectively for rotatable movement between a lower inoperative position and a raised operative position for supporting portions of truck trailers to be transported, the support arms each being in a generally A-shaped configuration with an intermediate first cross beam and with a first pivot rod at lower ends and with a transverse brace at upper ends, each transverse brace being formed in an L-shaped configuration with a lower horizontal extent and an upper vertical extent for receiving a portion of a truck trailer to be supported and transported;

a pneumatic cylinder for each pair of support arms and having a lower end pivotally secured with respect to a second pivot rod and an upper end pivotally secured to said first cross beam, the cylinder adapted to raise and lower the transverse braces; and a pair of vertical connected posts having upper ends rotatably secured to the cross beam and free lower ends positionable in cups secured to the frame adjacent to central extents thereof.

3. The apparatus as set forth in claim 2 and further including:

a brake system having horizontally reciprocable shoe coupled to the frame and movable into and out of locking contact with the axles with a source of pressurized air for providing pressurized air for generating actuating forces and with pneumatic lines positioned on the frame and extending from adjacent the forward end to adjacent the rear end of the passage of said pressurized air from the sources for braking the wheels and with an actuation wheel secured to one side of the frame for the manual providing of actuating forces for braking the wheels.

4. The apparatus as set forth in claim 2 and further including:

coupling mechanisms extending forwardly of the forward end and rearwardly of the rearward end for coupling together plural bogies to be transported in systems configuration.

* * * * *